United States Patent [19]

Eng et al.

[11] 4,378,286

[45] Mar. 29, 1983

[54] FILTER PRESS TYPE ELECTROLYTIC CELL AND FRAMES FOR USE THEREIN

[75] Inventors: Jeffrey D. Eng, North Vancouver; Cyril J. Harke, Bunaby, both of Canada; Tsujihiko Eukunaga, Grand Island, N.Y.; Helmuth Schurig, Holzwickede; Luciano Mosé, Dortmund, both of Fed. Rep. of Germany

[73] Assignee: Occidental Chemical Corporation, Niagara Falls, N.Y.

[21] Appl. No.: 220,595

[22] Filed: Dec. 29, 1980

[51] Int. Cl.[3] ..... C25B 9/00; C25B 11/10

[52] U.S. Cl. ..... 204/257; 204/279; 204/290 F; 204/292

[58] Field of Search ..... 204/252-258, 204/263-266, 279, 98, 290 F, 292

[56] References Cited

U.S. PATENT DOCUMENTS

| | | | |
|---|---|---|---|
| 2,872,406 | 2/1959 | Buchanan | 204/295 |
| 4,056,458 | 11/1977 | Pohto et al. | 204/263 |
| 4,059,495 | 11/1977 | de Nora et al. | 204/98 |
| 4,069,128 | 1/1978 | Westerlund | 204/258 |
| 4,069,129 | 1/1978 | Sato et al. | 204/258 |
| 4,129,495 | 12/1978 | Fitch et al. | 204/279 |
| 4,138,295 | 6/1979 | de Nora et al. | 204/98 |
| 4,149,952 | 4/1979 | Sato et al. | 204/258 |
| 4,196,069 | 4/1980 | Mosé et al. | 204/257 |
| 4,217,199 | 8/1980 | Cunningham | 204/256 |
| 4,256,562 | 3/1981 | Mosé et al. | 204/258 |
| 4,272,352 | 6/1981 | Jizaimaru et al. | 204/279 |
| 4,295,953 | 10/1981 | Fuseya et al. | 204/263 X |
| 4,315,810 | 2/1982 | Kircher | 204/288 X |
| 4,315,811 | 2/1982 | Kircher | 204/288 X |

*Primary Examiner*—Donald R. Valentine

*Attorney, Agent, or Firm*—James F. Tao; William G. Gosz

[57] ABSTRACT

A filter press type electrolytic cell for the electrolysis of brine to produce chlorine and caustic includes a plurality of rectangular frames having U-shaped or channel-shaped walls, the open sides of each of which wall members face inwardly, and a downcomer tube in each frame for conducting product from near the top of the frame to the bottom thereof for withdrawal. The downcomer tubes are located near a framing side but are not within a framing channel. The openings of the framing walls are partially covered by cross members of the same material as the framing to improve the resistance thereof to distortion during closing of the cell. Utilization of the downcomer tubes, preferably of polytetrafluoroethylene for the catholyte compartment and titanium or titanium clad material for the anolyte compartment, allows the maintaining of the framing channel open so that inner walls thereof are electrolytically protected against corrosion. Otherwise, when enclosed or tubular framing members are employed inner wall portions thereof can become corroded after relatively short periods of use. The invention also relates to frames for use in filter press type electrolytic cells and to a method of electrolyzing, wherein such frames and cells may be employed.

12 Claims, 5 Drawing Figures

FILTER PRESS TYPE ELECTROLYTIC CELL AND FRAMES FOR USE THEREIN

This invention relates to a filter press type of electrolytic cell. More particularly, it relates to such cells which include multiplicities of anolyte compartment frames and catholyte compartment frames of particularly advantageous types and structures. The invention also relates to the cell frames and to a method of electrolysis.

Filter press type electrolytic cells for the electrolysis of aqueous salt solutions are well known and have been commercially employed for the production of chlorine and caustic from brine. In some cases the frames of such cells have been hollow or one or more of the framing members have been hollow and electrolyte has been flowed through them. See U.S. Pat. Nos. 4,069,129 and 4,149,952, for example. Although in recent years efforts have been made to utilize synthetic organic polymeric materials as materials of construction for electrolytic cell parts, including filter press type cell frames, and although such parts possess various advantages, including electrical insulating properties and, in many cases, excellent corrosion resistance at comparatively low cost, they are sometimes not completely satisfactory, often because of poorer strength characteristics than similar parts made of metals, such as steel. Prior to the present invention it was attempted to make a stronger filter press type of electrolytic cell wherein the frames were of suitable metals which are resistant to chemical attacks by the electrolyte and product(s) of electrolysis in contact with them. In an embodiment of such an apparatus the frames were constructed of hollow framing members joined together in such a way that at least a side framing portion would act as a duct for electrolyte containing product(s) of electrolysis, allowing such to flow from the top of an electrolyte compartment to the bottom thereof without mixing with the body of electrolyte between the electrodes, and thence to a manifold, header or other means for conducting such fluid away from the electrolytic cell. Such framing members, while initially satisfactory, have been found to be susceptible to corrosion during continued use. It has been noted that such corrosion occurs on interior surfaces of the hollow frames which are in contact with fluid flowing through them. For example, when the frames of such type are cathode frames of steel, the steel will corrode inside the hollows, on the interior frame surface farther away from the cell interior. It is considered that this corrosion is caused by a lack of cathodic currents at such location, due to shielding of inside walls farther away from such currents by intervening portions of the frames. In a similar manner, for hollow anode frames of titanium, such metal parts may corrode at extremities if exposed to high circuit potentials and anodic breakdown potentials, due to those locations being shielded from the low anodic polarization potentials of the cell. The mentioned corrosion can result in objectionable leakage, frame distortion and product losses.

Applicants have discovered that when the inside of a metal framing member, such as the inside of a side wall thereof, is filled with electrolyte and no intervening metal wall causes electric shielding, any tendency of such framing member to corrode is substantially diminished and often no corrosion will result. To obtain such electrolytic protection hollow frame channels were opened to the interiors of the cell compartments. The strength of such frames is improved by the presence of cross members or strips located between the ends of the bounding walls of the open channels and the desirable electrolytic protection of the channel interior is obtainable providing that at least a minimum of open space or a certain proportion of spacing to total channel area (absent the cross members) is present. Furthermore, to obtain the desired removal of product, including gaseous product, at the top of the cell compartment and transportation thereof to a header, manifold or other transport or storage means below the cell, it has been found important to provide a tube or downcomer, preferably vertical and cylindrical (but other tube types are also operative) and located near a framing side channel, which carries the electrolyte downwardly without mixing it with bulk electrolyte and which is of a material which can withstand the electrolyte to which it is subjected. The downcomer is not positioned against the frame and will normally be away from it a distance corresponding to at least half the downcomer diameter or average width, preferably from ½ to 5 times such width, e.g., 1 to 3 times the width. Often it may be preferable for the material of the downcomer to be a fluorinated polymer, such as polytetrafluoroethylene, but it can also be titanium or steel or other metal in the appropriate circumstances. Utilizing such frame and cell structures one can obtain the strength benefits and other advantages of metal frames, good circulation of electrolyte and removal thereof at a desired rate from the cell, without the danger of corrosion of the cell framing members and auxiliary parts.

In accordance with the present invention, in a filter press type electrolytic cell for electrolysis of an aqueous salt solution, wherein a plurality of frames having electrodes held thereto is assembled in filter press type arrangement, separated from each other by membranes, diaphragms or microporous separators, forming a plurality of anolyte and catholyte compartments, the inventive improvement comprises said frames being hollow walled with openings therein facing inwardly, means for adding anolyte feed to the anolyte compartments through the frames thereof at bottom portions thereof, means for adding catholyte feed to the catholyte compartments through the frames thereof as bottom portions thereof, means for withdrawing anolyte containing dissolved solid and gaseous electrolysis product from near the tops of the anolyte compartments and conducting it downwardly through the compartment to communicate with an anolyte header located below the anolyte compartments, and means for withdrawing catholyte containing dissolved solid and gaseous electrolysis products from near the tops of the catholyte compartments and conducting it downwardly through the compartments to communicate with a catholyte header located below the catholyte compartments. Preferably the electrolytic cell is employed for the electrolysis of brine to make chlorine and caustic, the frame of the anolyte compartment is titanium or is titanium clad, the frame of the catholyte compartment is steel, cross members for the channels of the framing members are of the same materials as such channels and the downcomers are cylindrical and of polytetrafluoroethylene. In other aspects of the invention, frames, such as those described above are manufactured for subsequent assembly into a filter press type of electrolytic cell, and electrolysis of brine is practiced by a method which utilizes such frames and cells.

The invention will be readily understood by reference to this specification, including the following description, taken in conjunction with the drawing, in which.

Figure 1:
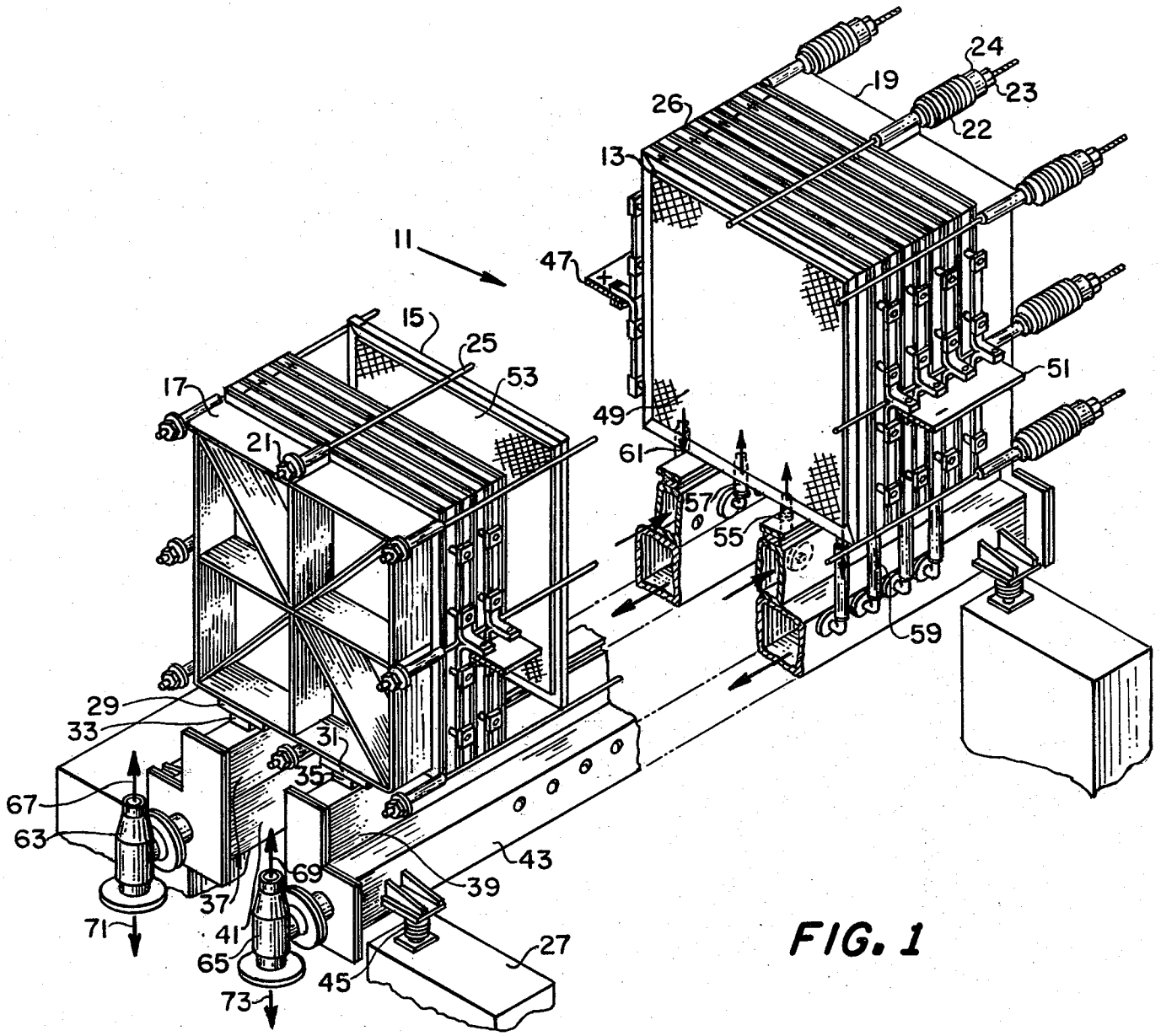
FIG. 1 is a perspective view of a filter press type electrolytic cell of the present invention, with portions removed so as better to illustrate the positionings and structures of the cell frames and other parts thereof.

Referring to FIG. 1, an electrolytic cell 11 of the filter press type includes a plurality of anolyte compartment frames or anode frames 13 and catholyte compartment frames or cathode frames 15 in alternating arrangement. Such frames are held together in fluid tight filter press type arrangement by end compression members 17 and 19, which maintain the assembly of frames in compression upon tightening of nuts 21 and 32, for example, on threaded rod 25, with similar assemblies about the peripheries of the compression members. Springs 22 and washers 24 are present near an end of such rod and at ends of the other similar tightening rods. Between the anolyte and catholyte compartment frames are suitable separators 26, which may be permselective or other membranes, e.g., DuPont's Nafion®, diaphragms, e.g., asbestos or suitable substitute, or porous separators, e.g., microporous PTFE, or of equivalent structure and/or function, and gasket members, positionings of which will be shown more clearly in FIGS. 3-5.

The electrolytic cell and the assembly of anode and cathode frames, in the embodiment of the invention illustrated, are ultimately maintained in position by suitable supporting member 27, which usually rests on a foundation or a concrete slab, not shown. The assembly of frames rests on members 29 and 31, which are separated by insulator plates 33 and 35, respectively, or pluralities of such plates, from the tops of inlet headers 37 and 39, respectively. The inlet headers are joined to outlet headers 41 and 43, which connect with supports 27 by means of insulator-flange assemblies 45.

Electricity is conveyed to the electrodes via bus assemblies 47 for anodes 49, and 51 for cathodes 53. Connections of the feeds to the anolyte compartments are representatively illustrated at 55 and corresponding connections to the catholyte compartments are represented at 57, with outlets from such compartments being shown at 59 and 61, respectively. Feed lines to the inlet manifold are provided but are not shown in the drawing, being obscured by parts of the illustrated cell assembly. Outlets from the anode product header 43 and the cathode product header 41 are shown at 65 and 63, respectively. As is indicated by arrows 67 and 69, when the electrolytic cell is employed for the electrolysis of brine, gaseous electrolytic products, which have been separated from accompanying liquid in headers 41 and 43, respectively, at least by the time the fluids reach the outlets, pass upwardly to a suitable collector, with arrow 67 representing the passage of hydrogen and arrow 69 representing that of chlorine. Similarly, arrows 71 and 73 respectively represent flows of caustic solution and depleted brine.

Figure 2:
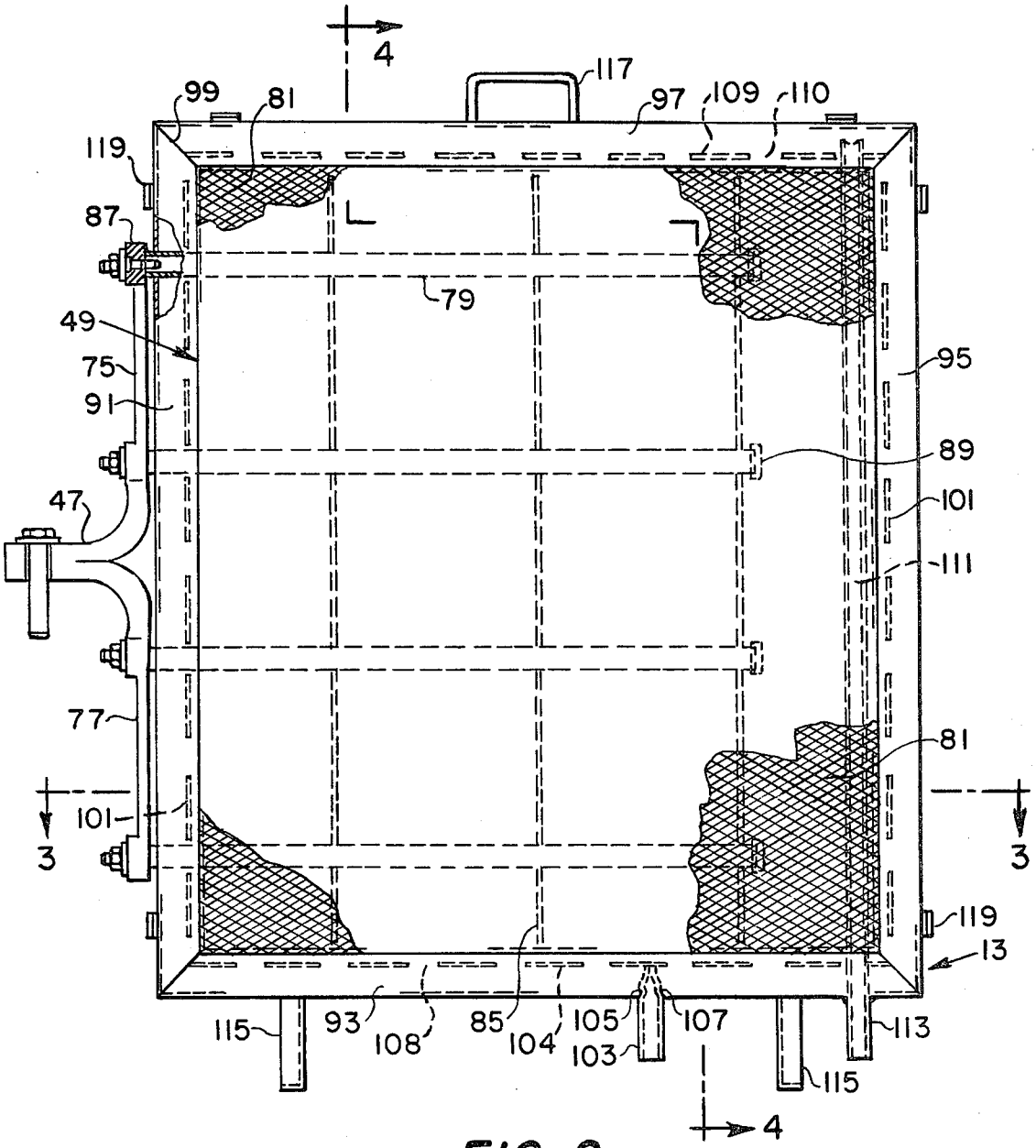
FIG. 2 is a front elevational view of an anolyte compartment frame of the type shown in FIG. 1.
Figure 3:
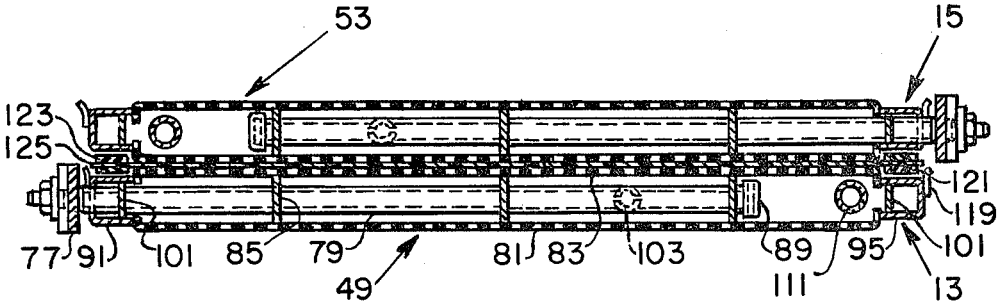
FIG. 3 is a sectional view taken along plane 3—3 of FIG. 2, also showing an adjacent catholyte compartment.
Figure 4:
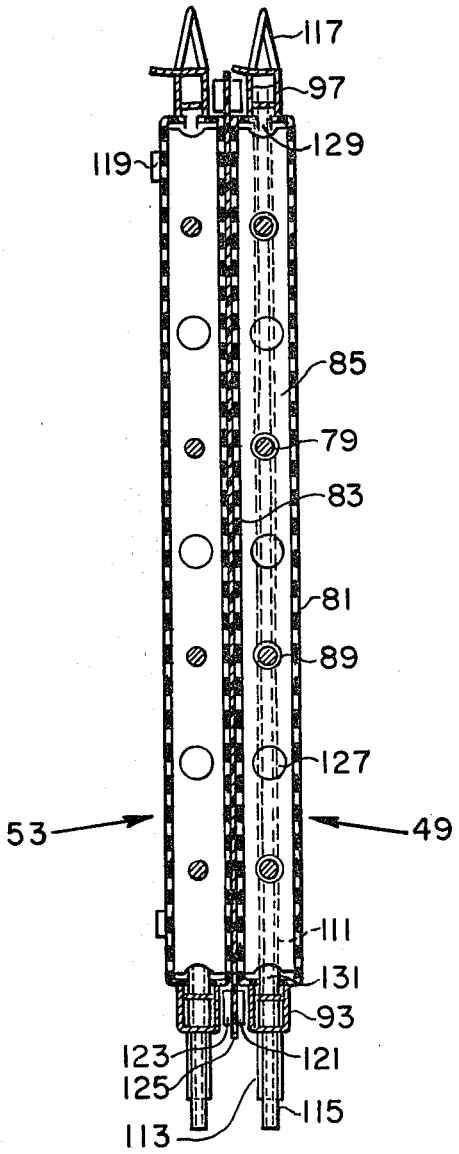
FIG. 4 is a sectional view taken along plane 4—4 of FIG. 2, showing such a catholyte compartment.

FIGS. 2-4, which show details of the anolyte compartment frame structure, may also be considered as substantially illustrative of the corresponding catholyte compartment frame structure, with only relatively minor structure changes (materials of construction, of course, are different), and it is one of the advantages of the present invention that similar shaped parts may be used in the different frames, frame connections and accessories. To save unnecessarily repetitious illustrations and discussions, descriptions of the electrolyte compartment frame of FIGS. 2-4 with respect to the anolyte compartment frame may be taken as applicable to the catholyte compartment frame, except for such changes as will be indicated or are apparent.

In FIG. 2 bus assembly 47 is essentially centrally positioned vertically with respect to the anodes (at mid-heights) and includes an upwardly extending electrically conductive member 75 and a downwardly directed conductive member 77 to carry direct current from a previous cell, not shown, to the four illustrated anode conductor rods 79, which, in turn, transmit the electricity to the active anodic surface 81 of anode 49. The electrical contacts between members 75 and rods 79 are made by means of connectors 87. The conductor rod ends are covered by caps 89. It will be evident that the anode illustrated in FIGS. 2-4 has two active anodic surfaces, of which surface 83 is shown in FIGS. 3 and 4, with surface 81. The positioning and spacing of the active electrode surface materials of surfaces 81 and 83 are controlled and current is transmitted to the active electrode surfaces via connectors 87 and conductors 79 by vertical spacer-conductors 85. After passage of the direct electric current from the anode bus to the anode, thence through the electrolyte and to the cathode and cathode bus, it is conducted to a similar anode bus, not shown, for a subsequent cell, not shown. Similarly, electricity is conducted to the anode bus of the presently illustrated cell from another cathode bus of a preceding cell.

The anode compartment frame shown in FIG. 2 includes four channel shaped or U members 91, 93, 95 and 97, suitably fastened together, as by welding or soldering or other effective fastening means, at gas- and liquid-tight mitered ends, such as that illustrated at 99. Across the openings of the channels and near the open ends thereof are fastened, as by welding or by other suitable means, cross members, such as that indicated by numeral 101, which help to strengthen such open ends when the channels are under compression. The openings between the cross members allow the bulk electrolyte (anolyte in this case) to be in direct contact with that in the frame channels and provide electrolytic protection of the metal, thereby helping to prevent corrosion thereof. In addition to providing for electrolytic protection of the channel interior walls and preventing or limiting corrosion of such walls, these partial cross members reinforce the frames.

A single feed adding inlet means 103 is provided, having openings 105 and 107 therein for directing feed to the anode compartment horizontally and longitudinally with respect to the frame channel, from whence the feed and circulating electrolyte proceed upwardly through the various openings, such as that identified by numeral 108, between the cross strips 104 of the bottom framing member and thence upwardly past electrode surfaces 81 and 83, through similar openings, such as that represented by numeral 110, between strips 109 of the top framing member, and down downcomer tube 111 (the entrance to which is above the top framing portion cross member) and out of the frame through exit portion 113 of tube 111. The inlet to the anode frame communicates with a brine header and the downcomer similarly communicates with an anolyte header, as shown in FIG. 1. Of course, means are provided, such as liquid-tight welded joints, to prevent any leakage between the frame and inlet tube 103 and/or outlet 113. In addition to the product taken off through downcomer 111, which is a mixture of gas and liquid, much more electrolyte also circulates downwardly through the vertical side framing members, such circulation being promoted by the difference in density between the gas-containing liquid moving upwardly and the essentially gas-free liquid moving downwardly. Thus, good electrolyte circulation is maintained, as the desired amount of product is taken off through downcomer 111. It has been found that the invented structure operates satisfactorily with the inlet and outlet on one side of the frame, apparently due at least in part to the circulation mechanism described. Thus, convenient mountings of the frames for communication with inlet and outlet headers or manifolds is feasible.

The assembled frames, with electrodes, conductors, inlet(s), outlet(s), and seals, are easily installed and removed and the construction illustrated facilitates electrical "jumping" of cells, when that is desired, due to some malfunction in one or several cells of a bank. Additional features of the frames to facilitate easy handling include support-stops 115, carrying handle 117 and guide-retainers 119, the last being better shown in FIGS. 3 and 4, and another membrane holding structure, being illustrated in FIG. 5. It will be noted that supports 115 can prevent damage being done to inlet 103 and outlet 113 when the frame is being handled or stored outside the cell, and additionally, can serve to guide one installing the frame in the cell, in locating it appropriately with respect to connections to inlet and outlet headers or manifolds.

It is a feature of this invention that a similar structure may be employed for the catholyte compartment frame assembly, although materials of construction will be different and specific designs may be changed. Thus, for example, the same frame shapes may be used, with the frames for the anode compartments being of titanium or titanium clad steel and those for the cathode compartments being of steel or nickel or nickel clad steel. The cross members will be of the same materials. Similarly, the downcomer tubes will usually be cylindrical, with those of the anode compartments being of titanium or fluorinated polymers like PTFE, and those of the cathode compartments being of a perfluorinated polymer, e.g., polytetrafluoroethylene or nickel metal. Of course, as is illustrated in FIG. 1, the catholyte compartment inlet and outlet are on different sides of the electrolytic cell than those of the anolyte compartment but the same frame dimensions may be utilized, with the frames merely being turned 180°. In some instances, were compensating advantages are obtainable by utilizing different framing structures for the anolyte and catholyte compartments, such different constructions may be employed but even in such cases similar fittings and elements may be utilized. Thus, when an improved "snubbing" means for holding a separator in place is used, which may involve different peripheral frame structures so as best to hold the separator, the same types of inlets and downcomers may be employed and in some instances the same materials of construction may be utilized.

In FIG. 3 is shown the frame assembly of FIG. 2 but additionally there is illustrated in place a catholyte compartment frame 15 and intervening gaskets 121 and 123 holding separator 125 between the anolyte compartment frame 13 and the catholyte compartment frame 15. Similarly, gasketing materials and another separator will provided between cathode compartment frame 15 and the next anode compartment frame, which will be like that designated 13. In such cell frame arrangements suitable mounts for the separators are present between each anolyte compartment frame and each catholyte compartment frame adjacent to it.

FIG. 4 shows the anolyte compartment frame of FIGS. 1–3, next to a catholyte compartment frame, with only a few different structural features being present. Accordingly, only those will be referred to here. Circular holes 127 are present in spacer supports 85 to provide a measure of circulation and communication of electrolyte within the frames. Additional clearances 129 and 131 are present at the top and bottom of the frame, respectively. Thus, in the four created sections of each electrolyte compartment, bounded by the electrodes and ribs 85, lateral mixing of electrolyte is provided.

Figure 5:
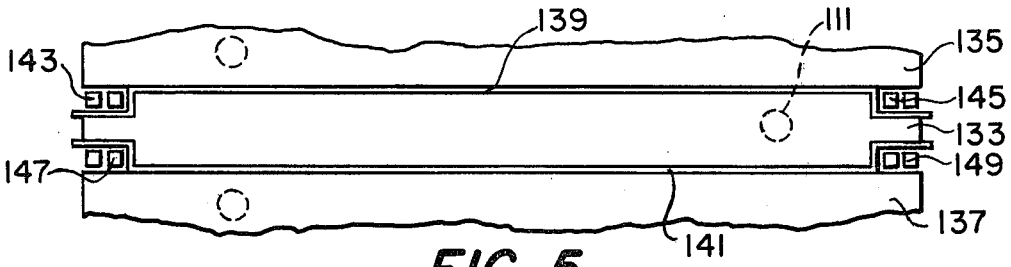
FIG. 5 is a top plan view of parts of two catholyte compartment frames about one anolyte compartment frame, illustrating an improved way of holding in place a suitable separator between the electrodes, which are held to the framing members.

In FIG. 5 there is illustrated an anolyte compartment frame 133 with parts of two catholyte compartment frames 135 and 137 sandwiching it. It will be noted that in this embodiment the catholyte compartment frames are essentially rectangular frame structures while the anolyte compartment frame is stepped. Although it is not illustrated in FIG. 5, both may utilize the channel construction of the frames of FIGS. 1–4. The compartment framings accommodate a different type of gasketing arrangement from that of FIGS. 1–4, and in it separators 139 and 141 are "snubbed" in place, held by gaskets 143, 145, 147 and 149, between the compartment frames. The frames may still be of channel shape but will preferably be modified, as indicated, and the spacers for the electrodes will be changed accordingly.

The materials of construction for the various parts of the assemblies will be those which are capable of withstanding exposures to chemicals with which they come into contact under operating conditions. Thus, the anolyte compartment frames and associated parts in contact with the anolyte will be such as to be capable of withstanding the actions of alkaline and/or acidic brines in the presence of chlorine whereas the catholyte compartment frames and catholyte contacting parts will resist corrosion by caustic mixtures. Generally, the anolyte compartment frames, conductors and associated hardware will be of titanium or titanium clad copper or steel or other such metal or suitable other material and the base material for the anodes will be in the form of wire mesh or screening, or perforated or expanded metal. Dimensionally stable anodes of the types known in the art are often preferred. Corresponding parts of the catholyte compartment framing, cathodes and conductors will often be of steel, nickel, stainless steel (high chromium or high nickel content), nickel clad steel, nickel clad copper, stainless steel or copper or stainless steel on steel, with the electrodes also preferably being in the form of screening or expanded metal. Various synthetic organic polymers are useful for the catholyte compartment downcomer. For example, chlorofluoropolymers may be employed, preferably polymers of lower alkylene which are perhalogenated. Of these, PTFE is highly preferred. However, PVC, chlorinated PVC and polypropylene are also useful. Gasketing materials may be of polychloroprene, butyl rubber or natural rubber in many instances but EPDM may be preferred. Similar materials of construction, conduits and seals may be utilized in the feed and discharge lines and headers and in the valves employed therein, as may be other materials that tolerate the environmental conditions.

For best operation and greatest resistance to electrolytic corrosion of the metal frame parts the openings between the cross members thereof will normally be at least 5% of the area of the channel openings before installation of the cross strips. Preferably this ratio will be from 20 to 95%, more preferably from 50 to 95% for good strengthening and obtaining of corrosion prevention. It is preferable to utilize only one downcomer tube, which will be of an electrolyte resistant material, preferably titanium, nickel, polytetrafluoroethylene, chlorinated PVC or polypropylene for the appropriate medium. Such tube is preferably cylindrical and will usually be located near a frame side. Although one downcomer is sufficient, as is one feed inlet, pluralities of these may be employed, if desired.

The relative dimensions of the various parts may be changed to modify cell operations and for uses of the invention in different electrolytic processes. Different shapes of the frame channels, downcomer tubes and cell frames may be utilized and modifications may be made in the various conductors, seals, passageways, channels and manifolds without losing the prime advantages of the present invention, a strong filter press type cell frame, made of an electrically conductive metal frame which is not subject to corrosion even over lengthy operating periods (which corrosion was noted in other metal frames which serve as means for circulating and/or removing product from the cell). The sizes of the downcomers and frame channel passages should be regulated to give best electrolyte circulations in the cells and the sizes of the downcomers and the product removal headers are preferably such that the product being withdrawn is in non-turbulent flow in the header, so that separation of gas from liquid therein is facilitated, with such separation being effected by at least the more downstream portion of the header, e.g., the last 20% of its length.

In practicing the process of this invention normal filter press type cell operating conditions for the particular electrolytic operations may be employed and the indicated desirable results are obtainable. Thus, the operating voltage for the electrolysis of a brine solution, for example, may be about 3.5 to 4.5 volts, with the current density being about 0.2 to 0.4 ampere/sq. cm. in a 10 to 15 kiloampere monopolar cell equipped with dimensionally stable ruthenium oxide on titanium anodes, steel cathodes and Nafion® NX permselective membrane separators. Utilizing such electrolytic cells and the mentioned conditions, including a saturated or nearly saturated brine feed, with a depletion in sodium chloride content of the anolyte of about 35 to 75 grams per liter to produce a catholyte containing 25 to 40% sodium hydroxide and 50 to 90 parts per million of sodium chloride and chlorine containing about 0.5 to 1 volume percent of oxygen, when filter press type frames are utilized with cross members occupying about 10 to 25% of the open channel surface area, with downcomers and manifolds like those of the drawings and previous description, and so located, it is possible to operate the cells continuously for periods of a year or more without experiencing objectionable corrosion of the metal frames, whether these be of steel, titanium or other corrosion resistant metal.

The following examples illustrate but do not limit the invention. Unless otherwise indicated all parts are by weight and all temperatures are in °C.

EXAMPLE 1

A monopolar filter press type chlor-alkali like that illustrated in FIGS. 1–4 is assembled and is operated for about 12 weeks. The anode is ruthenium oxide on titanium (DSA), the cathode is expanded steel mesh and the separator is a permselective polytetrafluoroethylene-based membrane of the type sold by E. I. DuPont De Nemours Company as Nafion® NX. The filter press frame members are U-shaped, those of the anolyte compartment being of titanium and those of the catholyte compartment being of steel, with cross members of the same materials occupying about 15% of the open surface area of the openings of the U's. Downcomers are of polytetrafluoroethylene for the catholyte compartment and of titanium for the anolyte compartment. The voltage is 3.95 and the current density is maintained at about 3 kiloamperes per square meter during operation of the cell, which takes place for three consecutive months. The brine employed is of ion exchange quality and the feed water contains 56 p.p.m. sodium chloride. The anolyte is depleted about 50 grams per liter of sodium chloride during its passage through the cell and the catholyte withdrawn contains 33% of sodium hydroxide and 70 p.p.m. sodium chloride, with the chlorine produced containing about 0.7 volume percent of oxygen. After three months of operation no corrosion of the metal frames is detectable. In a similar experiment, utilizing essentially the same apparatus and conditions, with the exception that a different membrane is employed, also of the permselective type, the cell is operated for six months without any corrosion of the framing interior.

EXAMPLE 2 (Comparative Experiment)

When the structure of the apparatus is altered so that instead of utilizing downcomers for withdrawal from the cell of product and depleted anolyte, such are removed through vertical frame members, which are enclosed on the inner sides thereof, after six weeks of operation under the conditions recited in Example 1 objectionable corrosion of the framing is noted.

The invention has been described with respect to various embodiments and illustrations thereof but is not to be limited to these because it is evident that one of skill in the art with the present specification and drawing before will be able to utilize equivalents and substitutes without departing from the invention.

What is claimed is:

1. In a filter press type electrolytic cell for electrolysis of an aqueous salt solution comprising a plurality of frames each having top, bottom and side framing members, said frames having electrodes held thereto and assembled in filter press type arrangement, separated from each other by membranes, diaphragms or microporous separators, forming a plurality of anolyte and catholyte compartments, the improvement comprising said frames being hollow walled with openings therein in the top, bottom and side framing members facing inwardly, means for adding anolyte feed to the anolyte compartments through the frames at bottom portions thereof, means for adding catholyte feed to the catholyte compartments through the frames at bottom portions thereof, downcomer tubes for withdrawing anolyte containing dissolved solid and gaseous electrolysis product from near the tops of the anolyte compartments and conducting it downwardly through the compartments without mixing with the anolyte in the compartments to communicate with an anolyte header located below the anolyte compartments, and downcomer tubes for withdrawing catholyte containing dissolved solid and gaseous electrolysis product from near the tops of the catholyte compartments and conducting it downwardly through the compartments without mixing with the catholyte in the compartments to communicate with a catholyte header located below the catholyte compartments, each downcomer tube being positioned near a side frame but spaced apart therefrom, with one tube per electrolyte compartment.

2. In an electrolytic cell according to claim 1 the improvement which comprises the hollow electrolytic compartment frames being metallic.

3. In an electrolytic cell according to claim 2 the improvement which comprises the frames being rectangular and of U- or channel-shaped sides, with a plurality of cross members extending across the U or channel openings to help maintain them open and prevent distortions thereof when the filter press type electrolytic cell is assembled, under longitudinal compression, the electrodes held to the frames being monopolar electrodes, steel for the cathodes and titanium or titanium clad material for the anodes, with two of the same type of electrode being held to each frame, the frames being separated from adjacent frames by the membranes, diaphragms or microporous separators and the synthetic organic polymeric plastic downcomer, tubes of the catholyte compartments being of a fluorinated polylower alkylene.

4. In an electrolytic cell according to claim 3 the improvement which comprises the anolyte compartment frames being of titanium, the catholyte compartment frames being of steel and the total area of the openings between the members across the frame U's or channels of each compartment being at least 20% of the area of the corresponding channel openings without such members in place.

5. In an electrolytic cell according to claim 4 the improvement which comprises the downcomer tubes being of cylindrical shape, titanium for the anolyte downcomer and polytetrafluoroethylene for the catholyte downcomer.

6. In an electrolytic cell according to claim 5 the improvement which comprises the anolyte compartment downcomer tubes being on an opposite side of the cell from the catholyte compartment downcomer tubes.

7. In an electrolytic cell according to claim 6 the improvement which comprises a single feed adding inlet means being present for each of the electrolyte compartments, with orifices therein for directing the feed to be added to such compartment sidewardly in opposing directions along the frame bottom channel axis, so that the feed subsequently moves upwardly through the openings between the reinforcing cross members of the bottom channel and upwardly through the electrolyte compartment.

8. In an electrolytic cell according to claim 7 the improvement which comprises the sizes of the vertical downcomer tubes and the headers to which electrolyte is conducted by such tubes from the electrolyte compartments being such that at operating feed and removal rates the flow of the liquid-gas mixture is such that there is separation of the gas from the anolyte and catholyte.

9. In an electrolytic cell according to claim 8 the improvement which comprises the anolyte feed inlet means and the anolyte compartment downcomer being located on the same side of the longitudinal axis of the electrolytic cell for each of the anolyte compartments and the inlet means and downcomer for each of the catholyte compartments being located on the same side of such axis, different from the side where the anolyte inlet means and downcomers are located.

10. A frame for a filter press type electrolytic cell which comprises top, bottom and side framing members, in which the side members are U or channel shaped with the openings of the U or channels facing inwardly, a plurality of spaced reinforcing members extending across the channel openings in the side framing members to help maintain them open, with at least 20% free area, preventing distortions thereof when the frames are installed in a filter press type electrolytic cell and are subjected to compression, an opening in the bottom framing member for feed addition to an electrolyte compartment formed at least in part by the frame, an opening in the bottom framing member for removing product from such a compartment and means communicating with the outlet opening in the bottom framing member, for conducting product from the top of such an electrolytic compartment to a location under the compartment.

11. A frame according to claim 10 wherein the product conducting means is a cylindrical downcomer tube of polytetrafluoroethylene and the frame is a catholyte compartment frame.

12. A frame according to claim 10 wherein the product conducting means is a cylindrical downcomer tube of titanium or titanium clad metal or alloy for the anolyte compartment.

* * * * *